US007486798B2

(12) United States Patent
Anjanappa et al.

(10) Patent No.: US 7,486,798 B2
(45) **Date of Patent: *Feb. 3, 2009**

(54) METHOD AND APPARATUS FOR TOOTH BONE CONDUCTION MICROPHONE

(75) Inventors: Muniswamappa Anjanappa, Ellicott City, MD (US); Xia Chen, Baltimore, MD (US); Russel E. Bogacki, Richmond, VA (US); Adbo J. Babik, Bumpass, VA (US)

(73) Assignee: Mayur Technologies, Inc., Ellicott City, MD (US)

( * ) Notice: Subject to any disclaimer, the term of this patent is extended or adjusted under 35 U.S.C. 154(b) by 723 days.

This patent is subject to a terminal disclaimer.

(21) Appl. No.: 11/100,214

(22) Filed: Apr. 6, 2005

(65) Prior Publication Data

US 2005/0196008 A1 Sep. 8, 2005

Related U.S. Application Data

(63) Continuation-in-part of application No. 10/745,226, filed on Dec. 23, 2003, now Pat. No. 7,269,266.

(60) Provisional application No. 60/461,601, filed on Apr. 8, 2003, provisional application No. 60/517,746, filed on Nov. 6, 2003.

(51) Int. Cl.
*H04R 25/00* (2006.01)

(52) U.S. Cl. ..... 381/151; 381/326

(58) Field of Classification Search ..... 381/150, 381/151, 326; 181/128; 600/25; 607/56, 607/57; 367/131, 132; 455/100
See application file for complete search history.

(56) References Cited

U.S. PATENT DOCUMENTS

| | | | | |
|---|---|---|---|---|
| 4,498,461 | A | 2/1985 | Hakansson | 128/1 R |
| 4,562,432 | A | 12/1985 | Sremac | 345/184 |
| 5,033,999 | A | 7/1991 | Mersky | 600/25 |
| 5,163,093 | A | 11/1992 | Frielingsdorf et al. | 381/151 |
| 5,327,506 | A | 7/1994 | Stites, III et al. | 381/169 |
| 5,447,489 | A | 9/1995 | Issalene et al. | 600/25 |
| 5,455,842 | A | 10/1995 | Mersky et al. | 375/175 |
| 5,460,593 | A | 10/1995 | Mersky et al. | 600/25 |
| 5,579,284 | A | 11/1996 | May | 367/132 |
| 5,706,251 | A | 1/1998 | May | 367/132 |
| 6,411,828 | B1 | 6/2002 | Lands et al. | 455/569.1 |
| 6,823,171 | B1 | 11/2004 | Kaario | 455/41.1 |
| 2001/0024507 | A1* | 9/2001 | Boesen | 381/315 |

* cited by examiner

*Primary Examiner*—Curtis Kuntz
*Assistant Examiner*—Tuan D Nguyen
(74) *Attorney, Agent, or Firm*—Clifford H. Kraft

(57) ABSTRACT

A two-way communication system particularly valuable for noisy environments where a user has a tooth bone conduction microphone in his mouth normally controlled by a tongue switch that transmits an electrical signal representing speech to a retransmit module usually worn on the user's body or mounted on an earphone or headset where the speech electrical signal is retransmitted to a second user usually by RF. The retransmit module can also receive signals from the second user and transmit them to the earphone or headset thus providing two-way communication.

20 Claims, 7 Drawing Sheets

METHOD AND APPARATUS FOR TOOTH BONE CONDUCTION MICROPHONE

This application is a continuation in part of application Ser. No. 10/745,226 filed Dec. 23, 2003 now U.S. Pat. No. 7,269,266 which was related to an claimed priority from provisional patent application 60/461,601 filed Apr. 8, 2003 and to provisional patent application 60/517,746 filed Nov. 6, 2003. Applications 60/461,601 and 60/517,746 are hereby incorporated by reference.

BACKGROUND

1. Field of the Invention

The present invention relates generally to the field of microphones and more particularly to a tooth bone conduction microphone method and apparatus using two-way communication.

2. Description of the Prior Art

Conventional (air-conduction type) microphones are routinely used for converting sound into electrical signals. One such application is the Phraselator that is currently used by Department of Defense. The Phraselator primarily consists of a microphone, an automatic speech recognition module, a language translator, and a voice synthesizer with a speaker. The English phrases spoken by the user is captured by the microphone and translated to other languages such as Dari (used in Afghanistan), and sent to a speaker, which announces the equivalent Dari phrase.

Although usable, the Phraselator is highly vulnerable to typical military noise environment resulting in degradation of its performance. The performance improves when the user holds the microphone very close to his mouth, however it still does not work all the time. The microphone, due to the presence of typical military environment noise, does not accurately capture the spoken words. Microphones pick up the acoustic signals coming from any direction from any source and cannot distinguish. Directional microphones are superior in applications if the source of the sound is always from the same direction. However, even the best directional microphones have limitations when used in military noise environment. Conventional microphones cannot differentiate between the human voice and any other environmental sound. They are unable to reproduce the spoken sounds faithfully. In addition, the reverberation of the spoken sound introduces additional complexity in conventional microphones by way of repeated sound waves. Therefore, there is an immediate need to develop a microphone or an equivalent module that is immune to the surrounding noise(military or otherwise)and has improved signal to noise ratio.

The action of speaking uses lungs, vocal chords, reverberation in the bones of the skull, and facial muscle to generate the acoustic signal that is released out of mouth and nose. The speaker hears this sound in two ways. The first one called "air conduction hearing" is initiated by the vibration of the outer ear (eardrum) that in turn transmits the signal to the middle ear (ossicles) followed by inner ear (cochlea) generating signals in the auditory nerve which is finally decoded by the brain to interpret as sound. The second way of hearing, "bone conduction hearing," occurs when the sound vibrations are transmitted directly from the jaw/skull to the inner ear thus by-passing the outer and middle ears. As a consequence of this bone conduction hearing effect, we are able to hear our own voice even when we plug our ear canals completely. That is because the action of speaking sets up vibration in the bones of the body, especially the skull. Although the perceived quality of sound generated by the bone conduction is not on par with the sounds from air conduction, the bone conducted signals carry information that is more than adequate to reproduce spoken information.

There are several microphones available in the market that use bone conduction and are worn externally making indirect contact with bone at places like the scalp, ear canal, mastoid bone (behind ear), throat, cheek bone, and temples. They all have to account for the loss of information due to the presence of skin between the bone and the sensor. For example, Temco voiceducer mounts in ear and on scalp, where as Radioear Bone Conduction Headset mounts on the cheek and jaw bone. Similarly, throat mounted bone conduction microphones have been developed. A microphone mounting for a person's throat includes a plate with an opening that is shaped and arranged so that it holds a microphone secured in said opening with the microphone contacting a person's throat using bone conduction. Bone conduction microphones worn in ear canal pick up the vibration signals from the external ear canal. The microphones mounted on the scalp, jaw and cheek bones pick the vibration of the skull at respective places. Although the above-referred devices have been successfully marketed, there are many drawbacks. First, since the skin is present between the sensor and the bones the signal is attenuated and may be contaminated by noise signals. To overcome this limitation, many such devices require some form of pressure to be applied on the sensor to create a good contact between the bone and the sensor. This pressure results in discomfort for the wearer of the microphone. Furthermore, they can lead to ear infection (in case of ear microphone) and headache (in case of scalp and jaw bone microphones) for some users.

There are several intra-oral bone conduction microphones that have been reported. In one known case, the microphone is made of a magnetostrictive material that is held between the upper and lower jaw with the user applying a compressive force on the sensor. The teeth vibration is picked up by the sensor and converted to electrical signal. The whole sensor is part of a mouthpiece of a scuba diver.

Also, some experimental work has been done in using a tethered piezoelectric-based accelerometer mounted on teeth to measure bone conduction induced vibration and compared to standard signals. The accelerometer protruded through the lips making the approach difficult to implement in practice. The sensor is bulky and puts unbalanced load on the teeth making them useful only for experimental purposes, at the best. Therefore there still exists a need for a compact, comfortable, economical, and practical way of exploiting the tooth bone vibration to configure an intra-oral microphone and preferably wireless.

Two way communication using microphones and earset/headset is common in the art. With conventional microphone the two-way communication between two parties, with at least one situated in a noisy environment, is difficult at best. With an air conduction microphone, the speaker in the noisy environment typically needs to speak louder, often repeat, must orient himself away from the oncoming noise, keep the microphone very close to his mouth, and cover the microphone to reduce noise entering directly into the microphone. Even with this tiresome effort, there is no guarantee that the other party has heard everything. On the other hand, with bone conduction microphones, two way communication is done by wearing the bone conduction microphone externally making indirect contact with bone at places like the scalp, ear canal, mastoid bone (behind ear), throat, cheek bone, and temples. Bone conduction microphones have two major drawbacks; (1) they all have to account for the loss of information due to the presence of skin between the bone and the sensor that typically result in attenuation and loss of bandwidth, and (2) typically they require some form of pressure to create a good contact between the bone and the sensor that can lead to ear infection in case of ear microphone and headache in case of scalp and jaw bone microphones.

Intra-oral bone conduction microphones can be used for two way communication using magnetostrictive material-based microphones held between the upper and lower jaw, with the user applying a compressive force on the sensor. This technology is mostly suitable for scuba diving applications where the user does not have to make comprehensive conversation and is limited to short term use. Therefore, there exists a need for a noise immune two way communication technology that works well in background noise, does not require uncomfortable pressure on the bone, is easy to use, and has low in cost.

SUMMARY OF THE INVENTION

The present invention relates to a tooth microphone apparatus worn in a human mouth that includes a sound transducer element in contact with at least one tooth in mouth, the transducer producing an electrical signal in response to speech and a means for transmitting said electrical signal from the sound transducer to an external apparatus. The sound transducer can be a MEMS accelerometer, and the MEMS accelerometer can be coupled to a signal conditioning circuit for signal conditioning. The signal conditioning circuit can be further coupled to the means for transmitting said electrical signal. The means for transmitting said electrical signal can be an RF transmitter of any type, in particular a bluetooth device or a device that transmits into a Wi-Fi network or any other means of communication in particular Industrial, Scientific and Medical (ISM) band may be used. The transmitter is optional.

The present invention also relates to two-way communication between parties, especially when one of the parties is situated in a noisy environment. A communicator(s) situated in the noisy environment can wear a tooth bone conduction microphone in the mouth and will be able to transmit his/her voice with high signal to noise ratio and filtering out the surrounding noise. Hence the speaker can have hands-free conversation at normal voice level, does not have to repeat often, having complete freedom to stay in the location and position desired. Simultaneously the communicator(s) situated in the noisy environment can hear the voice transmitted by the other party through a conventional earset/headset. Two or more parties can communicate to each other with comfort even if they are situated in a noisy environment.

DESCRIPTION OF THE INVENTION

The present invention, a high sensitivity tooth microphone, uses the above-referred teeth vibration as the source of sound. The high sensitivity tooth microphone can include a high sensitivity accelerometer integrated with a signal conditioning circuit, and a probe. Optionally for wireless communication, a switch can be added to the microphone. An RF transmitter, power source, and Wi-Fi, Bluetooth, or other wireless communication technology can be used to transmit out of the mouth to a nearby receiver.

A free end of the probe is held in contact with the teeth during the action of speaking. The high sensitivity tooth microphone converts the teeth vibration produced by speaking to a proportional electrical signal. This electrical signal can either be directly fed to a speaker or stored for later retrieval and use or fed to a processor for translation.

There are several features of the high sensitivity tooth microphone that makes it ideal for minimizing or even eliminating the effect of all sounds that are not generated by the wearer of the microphone. The most important are:

- Since the vibration of the skull induced by the environmental noise is negligible compared to the vibration induced due to the act of speaking, this new microphone module will be able to accurately pick up the spoken information even in a noisy environment (noise can be as high as 160 dB) with very high signal to noise ratio,
- Since external reverberated sound waves do not affect teeth, the high sensitivity microphone almost completely eliminates their (reverberation) effect on the quality of audio signal,
- The high sensitivity microphone reproduces the spoken information faithfully with the highest signal to noise ratio even when the speaker is wearing medical, gas or other type of masks.
- As the tooth microphone uses the high sensitivity technology and converts sound into electrical signal directly, it is compact, simple in design and waterproof,
- Immune to environmental conditions and hence reliable and robust, and
- Many configurations that provide a convenient and comfortable package for wearing in the mouth.

The high sensitivity tooth microphone can use a microelectromechanical systems (MEMS) accelerometer or any other accelerometer that can be mounted in the human mouth. This is generally a single axis vibration sensor along with a signal amplifier on a single chip. It can have typical parameters such as a 225-$\mu g/\sqrt{Hz}$-noise floor, 10-kHz bandwidth. It can also be equipped with an on-board temperature sensor, which can be used for calibrating against temperature effects.

Figure 1:
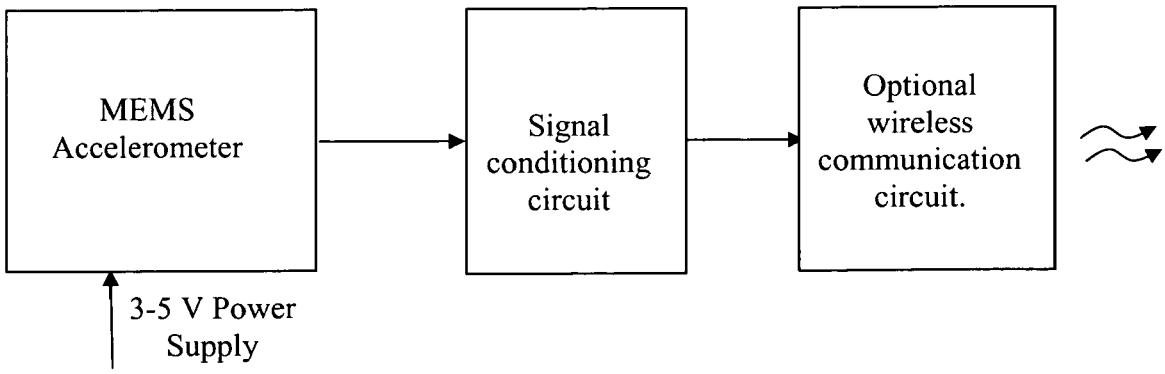
FIG. 1 shows an embodiment of the present invention.

The basic configuration of the high sensitivity tooth microphone is as shown in FIG. 1. The overall size of the accelerometer with the signal conditioning circuit in this embodiment is about $10\times10\times6.5\ mm^3$ with a multilayer circuit. The optional wireless communication circuit can also be about the same size. Since the amplitude of the teeth vibration is typically very small (as small as 0.1 μm), the sensitivity of a tooth microphone must be high enough to detect such small vibration. The sensitivity can be chosen by the resistors in a signal conditioning circuit. The overall design of the high sensitivity tooth microphone is generally chosen with the objective of attaining diverse goals such as small size, fabrication feasibility, durability, biological compatibility, and high precision.

Figure 2:
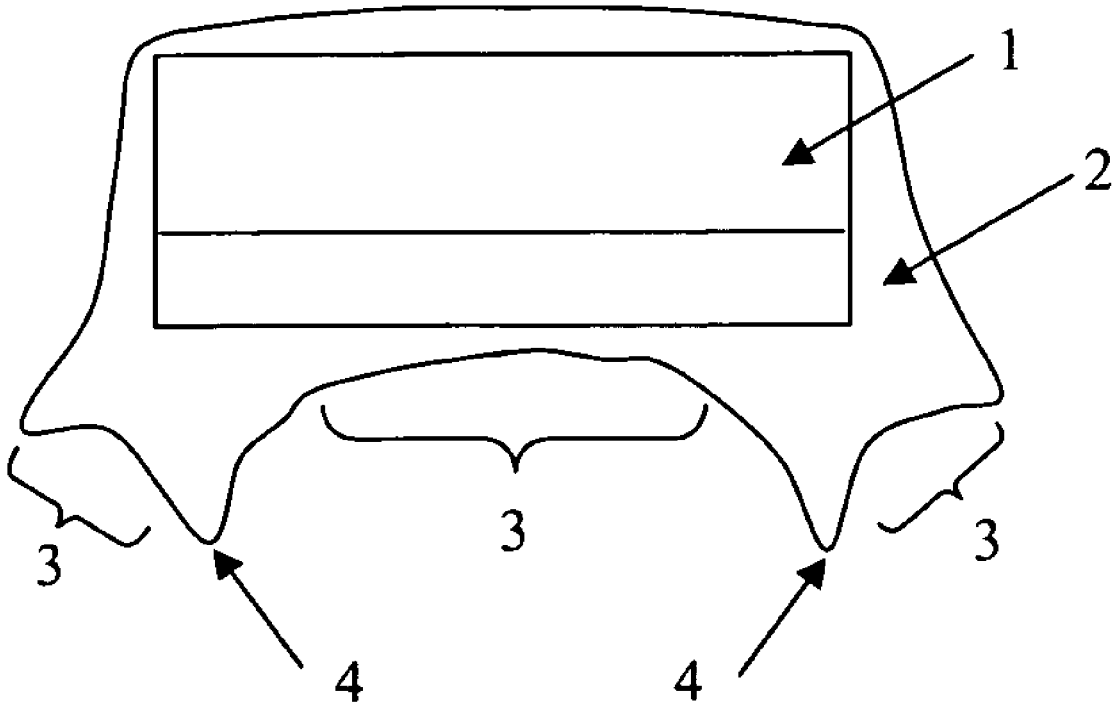
FIG. 2 shows a cross-sectional view of FIG. 1.

Packaging the high sensitivity tooth microphone is also an important aspect of the present invention. The technology of using teeth vibration for microphone use is generally the same irrespective of which specific tooth is used for coupling the probe. Although there are usually some minor variations between teeth, the overall signal is still sufficient to capture all the characteristics of the spoken sound no matter which tooth (or teeth) is chosen. The only difference is the final packaging of the microphone that varies by tooth placement, and whether it is maxillary or mandibular. FIG. 2 shows a preferred embodiment of the present invention. In this configuration, the high sensitivity tooth microphone is embedded in an acrylic or equivalent polymer. The contour of the embedded unit can be seen in FIG. 2. The contour is usually chosen so as to provide a good coupling between the acrylic and the teeth. The contour shaping normally requires a model of the teeth of the final user of the microphone. Therefore, the acrylic acts as the probe of the tooth microphone. In this case three molar teeth are in contact with the embedded tooth microphone thus providing a good coupling for bone conduction. This principle can be used in many variations by simply selecting different teeth for coupling purposes. For example, as alternative configuration, the embedded tooth microphone can be coupled to one tooth only or can be coupled with multiple teeth in all possible permutations and combinations. Finally either upper jaw or lower jaw teeth can be used to get similar results.

Similarly, in the preferred method, the outside of the right side molar teeth of upper jaw can be used for coupling purposes. One can easily reconfigure this device to couple with other (either upper jaw or lower jaw) surface of the teeth in all possible combinations. The choices of specific teeth depend on the user preference and wear comfort level. FIG. 2 shows the following: a high sensitivity tooth microphone 1, an acrylic resin build 2, a contour of the microphone and teeth interface 3, and deep coupling points into embrasures between teeth 4.

Figure 3:
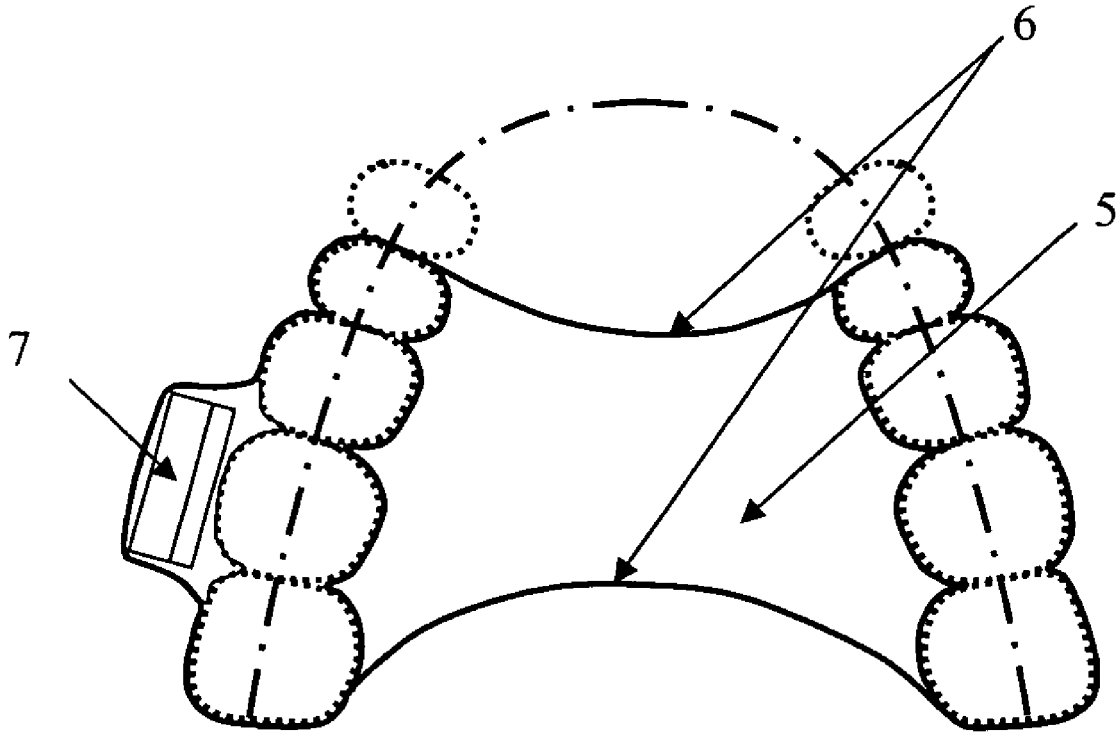
FIG. 3 shows a schematic diagram of a retainer with a microphone.

Once the high sensitivity tooth microphone is embedded in acrylic, it can be placed at the desired teeth location and encased in a polypropylene-based thermoplastic or equivalent material that has good wear resistance and durability. Although this process of fabricating the retainer can be achieved in several ways, vacuum forming is most economical. FIG. 3 shows a schematic diagram of the retainer obtained as a result of this process for the preferred embodiment. In FIG. 3, the embedded microphone is encased in the retainer that hugs multiple teeth on both sides of the upper jaw. The shape of the retainer is so chosen that it is big enough so choking, inhalation, or swallowing is impossible. Also, the retainer is undercut in the palate region to eliminate any impediment for free tongue movement in the speech critical areas. Following this principle, the shape of the retainer can easily be modified to suit specific user or application. FIG. 3 shows the following: a polypropylene retainer 5, cut outs in the retainer 6, and an embedded microphone 7.

Experiments have shown that the high sensitivity tooth microphone reproduces the entire spectrum of speech. Tests with "speech alphabets" that cover the full range of teeth vibration frequency, viz., vowels, diphthongs, plosives, nasals, fricatives, and approximants show excellent reproducibility. From these results, it is clear that the high sensitivity tooth microphone using bone conduction vibration, is a viable alternate to the conventional microphone.

Furthermore, the high sensitivity tooth microphone has been tested in noisy environments that proved that the new high sensitivity microphone is able to filter all sounds except the sounds produced by the wearer of the high sensitivity tooth microphone. For simplicity, the noise frequency range may be limited to 10 KHz. Most of the spoken voice can be captured from 200 to 8 KHz. So, with a 10 KHz it is assured that all the spoken sound signals can be captured. Simultaneously, the spoken language under noisy environment can be captured by conventional microphone for evaluation purposes. It was found out that the high sensitivity tooth microphone produces very high signal to noise ratio sound than conventional microphone since bone conduction is immune to the noise environment.

This unique features of the present invention make it ideal for applications that require communication in a noisy environment. This new microphone apparatus and method has many applications such as the Phraselators used by the Department of Defense, communication in professional sports, communication in airport tarmacs, naval aircraft carriers, language translators, audio components, communication in aircrafts, communication in underwater, communication with masks on, wearable computers, and special medical applications, to name a few.

Figure 4:
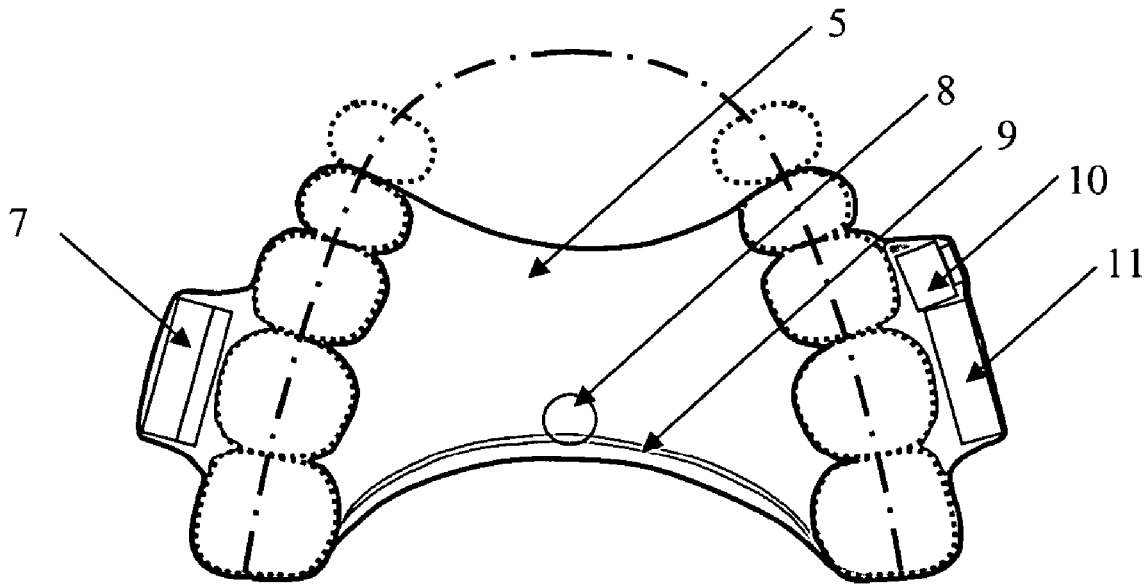
FIG. 4 shows an embodiment with wireless capability.

By adding a wireless communication unit, the high sensitivity tooth microphone has no physical wires exiting the mouth making the use most comfortable. FIG. 4 shows an embodiment of a high sensitivity tooth microphone with wireless communication option. In this configuration, the wireless communication circuit and the battery are embedded in acrylic and located at the outside surface of the teeth on the left side of the upper jaw. The battery is embedded such that it is accessible once the retainer is removed. The wire connection between the embedded tooth microphone and the wireless circuit is embedded into the polypropylene retainer as shown in FIG. 4. The position of embedded tooth microphone, wireless communication circuit and the battery can also be placed at different locations that are not shown here. Also, in this configuration, a tongue operated membrane switch can be placed preferably at the center of the palatal region as shown in FIG. 4. Alternatively, a voice activated switch could be included. FIG. 4 shows the following: High sensitivity tooth microphone 7, a retainer 5 Tongue operated switch 8, embedded connector between the microphone and a wireless communication circuit 9, Battery 10, Wireless communication circuit 11.

Figure 5:
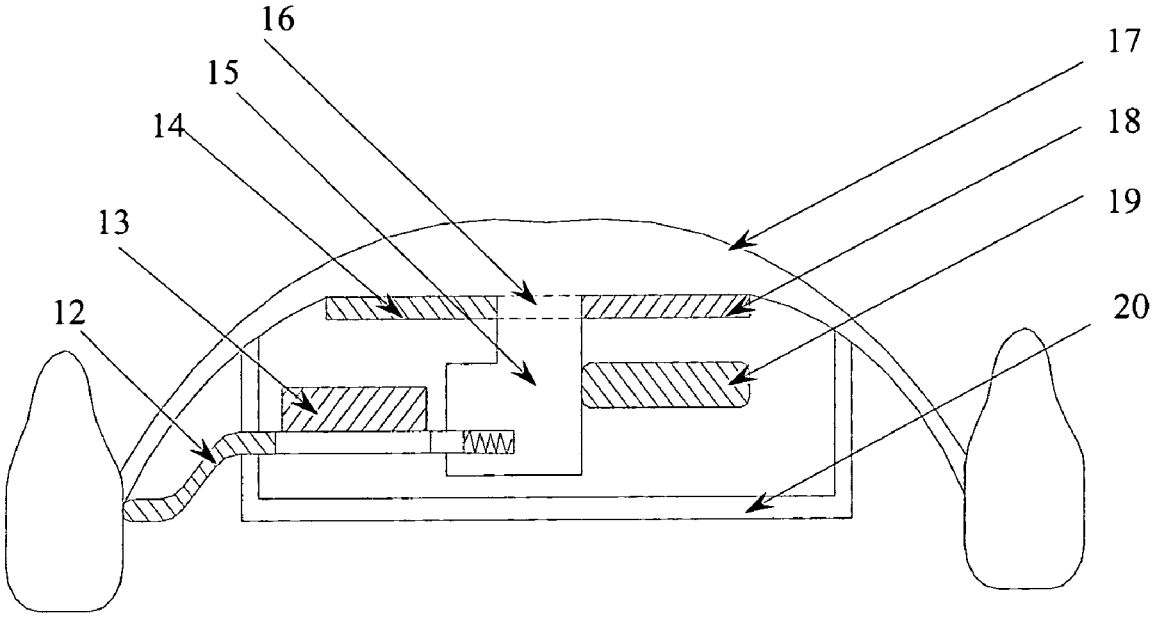
FIG. 5 shows an embodiment with a mounting strap.

FIG. 5 shows a second embodiment of the high sensitivity tooth microphone that is mounted on the metal palatal strap. The palatal strap is coupled to maxillary molar teeth with a wireless communication capability. The palatal strap, similar to the retainer, is normally custom made for each person. The configuration shows the coupling between the accelerometer and the teeth. A stainless steel (or other suitable material) probe is held against the teeth by a compression spring as shown. The accelerometer is rigidly mounted to the probe. The casing will hide all the parts inside its space except for the tip of the probe. The casing can easily be shaped to suit the application. The entire unit is made waterproof and biologically compatible. FIG. 5 shows the following: Teeth microphone probe 12, MEMS accelerometer 13, Signal conditioning circuit 14, support 15, ribbon cable 16, palatal strap 17, RF transmitter 18, battery 19, casing 20.

Figure 6:
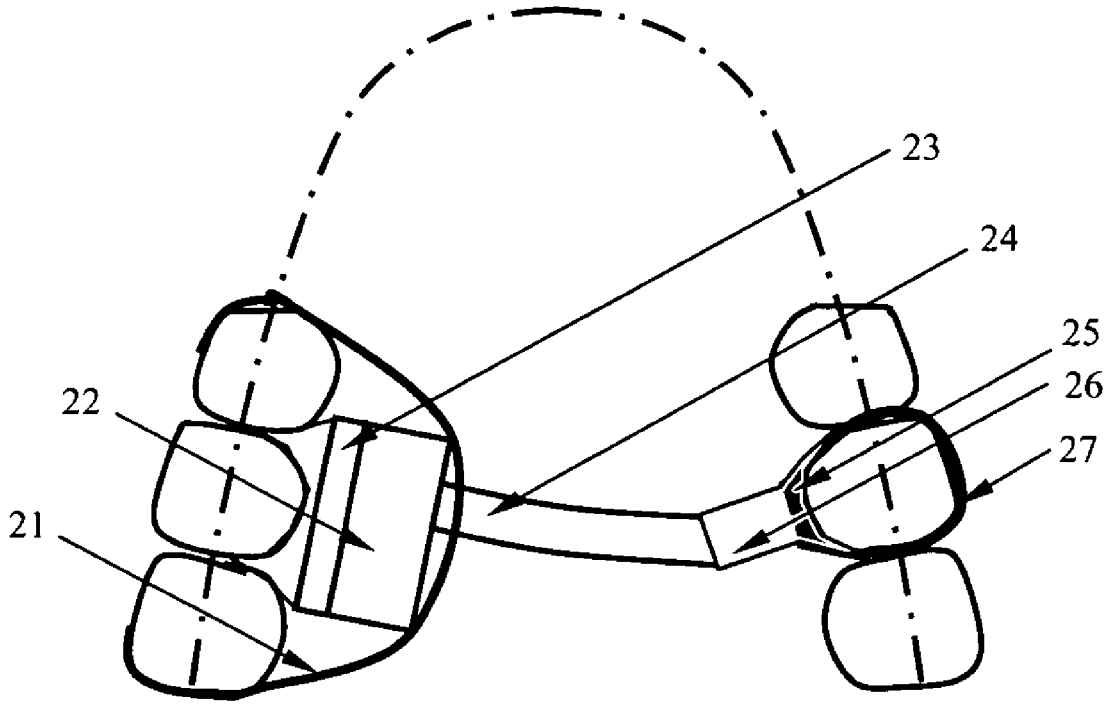
FIG. 6 shows another embodiment of the present invention.

Another embodiment of the present invention is as shown in FIG. 6. The high sensitivity tooth microphone with its probe is encased in a polymer such as acrylic. Good coupling is achieved between high sensitivity tooth microphone probe and the teeth through the transducer end fitting. The second component, transmitter, takes the voltage developed on the high sensitivity module, transmits the signal using standard RF transmitter. The wireless RF communication shown can be replaced by any other equivalent wireless technologies. FIG. 6 shows the following: a high sensitivity microphone 26, a transducer end fitting 25, a holding brace 27, a flexible ribbon 24, an RF transmitter 22, a battery 23, and a casing 21.

Many other embodiments are possible including, teeth cap with the integrated high sensitivity tooth microphone; the device attached to implants or denture, manually holding the embedded high sensitivity tooth microphone against teeth etc. When used as teeth cap or manually holding against teeth, there is no need to custom fit the user.

Figure 7:
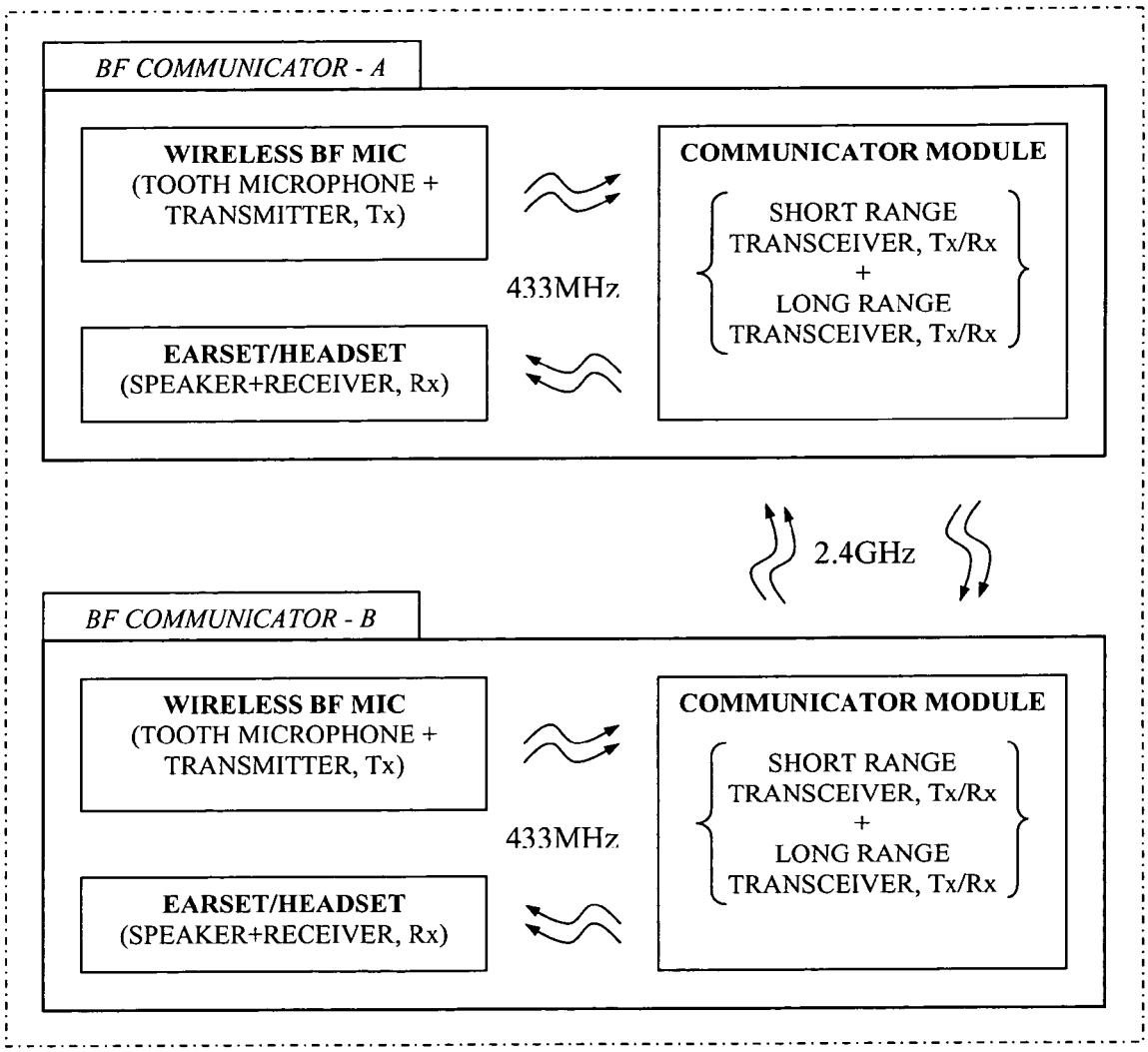
FIG. 7 shows a block diagram of a 2-way bone-conduction system.

Another embodiment of the present invention is a two-way bone conducting communication device that is very useful when one of the parties is situated in a noisy environment. A functional block diagram of a two-way bone conducting communication device using a tooth bone conduction microphone is as shown in FIG. 7. The example in FIG. 7 primarily consists of three components: a wireless tooth bone conduction microphone, a communicator module, and an earset/headset. The wireless tooth bone conduction microphone can be worn internally in the mouth; the communicator module can be worn externally such as clipped on a belt, and the earphone/headset can be worn in the ear or on the head. The communicator module could be combined with the earphone/headset.

The wireless tooth bone conduction microphone can be worn in the mouth as previously described. This wireless tooth bone conduction microphone can have at least two components: a tooth bone conduction microphone and a miniaturized wireless transmitter or other transmission means. The wireless tooth bone conduction microphone generally converts the spoken sounds into electrical signals that are converted to digital data and then transmitted in wireless manner at a particular frequency. In the preferred embodiment, the miniaturized wireless transmission can take place at a nominal 433 MHz. There are any number of other frequencies that could be used. Any frequency is within the scope of the present invention.

The communicator or retransmission module normally includes a multi-frequency transceiver. The user can wear this module on his body, preferably at the waist, to enable two-way communication as shown in FIG. 7. It can also be part of or mounted near the earphone or headset. The transceiver primarily can optionally include a short range transceiver and a long range transceiver. The short range transceiver can use 433 MHz or other frequency to receive the signals emitted by the wireless tooth bone conduction microphone and to transmit the signal to the earset/headset. The long range transceiver can use 2.4 GHz or other frequency to receive and transmit voice signals to another communicator module used by the second party. It should be noted that transmission does not have to be by RF, but can be by cable, fiber optic, light beam or any other transmission method. The long-range communicator or re-transmitter can located anywhere in proximity of the user The earphone/headset can include a speaker module of appropriate frequency range and a wireless receiver. The wireless receiver, in the preferred embodiment, uses 433 MHz or other frequency and provides audio into the user's ear.

An example will now be given of communication between two parties using the two-way bone conducting communication system of the present invention. User A, wearing a tooth bone conduction microphone, initiates the conversation by turning on a tongue operated switch shown in FIG. 7. A signal will be transmitted to his communicator module at a radio frequency such as 433 MHz to conserve the power. The transmit distance will normally be no longer than 1.5 meters. The short range transceiver within the communicator module will receive the voice signal. The long range transceiver of the communicator module can then re-transmit the signal to the communicator worn by user B optionally on a different frequency such as Bluetooth at 2.4 GHz frequency. This frequency in general should be chosen so as to not interference the wireless tooth bone conduction microphone transmission frequency. The long range transceiver of the communicator module worn by the User B receives the signal which is then transmitted to the earset/headset of User B via User B's short range transceiver. This process allows the User B to hear the voice of User A clearly even if the User A is situated in a noisy environment.

The reverse process of User A hearing what User B is saying is same as except that now the User B initiates the process by operating the tongue operated switch located in his BF Mic. Also, the users of two way bone conducting communication devices can keep the tongue operated switch in continuously on position by simply pressing and holding the switch for a pre-selected time span.

In another embodiment of the present invention, the two-way bone conducting communication device can easily be used by eliminating wireless feature between the tooth bone conduction microphone, communicator module, and earset/headset and instead use physical cables in applications where it is advantageous. Also, the wireless communication technology and frequency can be substituted with other similar technologies that have the same function. The frequency of communication for both the short range and long range transceivers of the two way bone conducting communication device can be changed to give the system more flexibility.

A few of the novel features of the present invention are as follows:

1. The present invention enables two parties to clearly hear each other's spoken voice even if one or both of them are situated in a noisy environment. The signal to noise ratio of the two-way bone conducting communication device is excellent.
2. The party using the present invention in a noisy environment can speak at normal levels and be assured that the other party can hear him clearly. Generally without the two-way bone conducting communication device, the user must speak louder and cover his microphone to overcome the surrounding noise.
3. The party using the present invention in a noisy environment can keep up a normal conversation with out having to repeat.
4. The user of the present invention will normally have his or her hands free to do other activities that are a major advantage for personnel in medical field, military, secret service, law enforcement, emergency response and similar applications.
5. The frequency of communication for both the short range and long range transceivers can be changed; hence the power consumption can be minimized and avoid eavesdropping.

Some of the applications that can benefit from these unique features are:

1. The present invention can provide a unique platform for secured communication in the military environment. Users can choose and change the frequencies for communication making it harder for hostile targets to listen to the conversation. The present invention can add tremendous value for command, control, and intelligence operations and secure communications networks. For example, a soldier in the battle field needs to communicate in a noisy and hostile environment. Whispering and keeping voice low and communicating unambiguously is critical to the operation which is made possible with this invention.
2. The present invention is ideal for private telecommunication networks where a group of people can communicate with each other in privacy.
3. Personnel working in heavy background noise such as airport tarmac staff, naval vessel personnel, coast guards, etc can benefit from a two-way bone conducting communication device to both improve their performance and also improve health safety.

4. The present invention provides many advantages when employed in the applications that can range from personal and asset ID to small private telecommunications networks.

5. The present invention allows the user to whisper or speak at low level voice (some time hide the action of speaking completely) and still communicate with the other party that make them ideal for many law enforcement and secret service applications.

6. Since the present invention can filter the background noise almost completely at the source, it is very suitable for emergency response personnel use such as police and firefighters.

7. Another major application of the present invention lies in the area of professional sports where background noise is extremely high.

8. An upcoming area of application is a wearable computer where the user needs both of his or her hands free and at the same time communicate in noisy environment where the conventional automatic voice recognition software are error prone.

It will be noted that several descriptions and figures have been used to explain the present invention. The present invention is not limited by these. One of skill in the art will recognize that many changes and variations are possible. Such changes and variations are within the scope of the present invention.

We claim:

1. A two-way tooth microphone communication apparatus comprising: a sound transducer element directly in contact with at least one tooth in a user's mouth, said transducer producing an electrical signal in response to speech by a user in a high ambient noise environment; a first transceiver module transmitting said electrical signal to an external apparatus, external apparatus in proximity to said user; a second transceiver module in said external apparatus retransmitting said electrical signal to a second user.

2. The tooth microphone apparatus of claim 1 wherein said sound transducer is a MEMS accelerometer.

3. The tooth microphone communication system of claim 1 wherein said first transceiver module is coupled to an earphone or headset worn by said user.

4. The tooth microphone communication system of claim 1 wherein said first transceiver transmits on a first set of frequencies and said second transceiver transmits on a second set of frequencies.

5. The tooth microphone communication system of claim 4 wherein said first set of frequencies contains only one frequency.

6. The tooth microphone communication system of claim 4 wherein said second set of frequencies contains only one frequency.

7. The tooth microphone communication system of claim 4 where at least one frequency of said first set of frequencies or said second set of frequencies is in an Industrial, Scientific and Medical (ISM) band.

8. A method for two-way tooth microphone communication apparatus in a noisy environment comprising: placing a sound transducer element in a first user's mouth, said sound transducer element directly in contact with at least one of said first user's teeth, said sound transducer producing an electrical signal representative of speech by said user in a high ambient noise environment; coupling an RF transmitter to said sound transducer element so that said electrical signal is transmitted to a retransmission module; causing said retransmission module to retransmit said electrical signal to a remote station.

9. The method of claim 8 wherein said sound transducer element is a MEMS accelerometer.

10. The method of claim 8 further comprising transmitting said second electrical signal from said retransmission module to an earphone or headset worn by said first user.

11. The method of claim 8 wherein said retransmission module transmits into a Wi-FI network.

12. A two-way tooth microphone communication apparatus for capturing speech in a noisy environment comprising a tooth bone microphone directly in contact with at least one tooth in a user's mouth, said tooth bone microphone producing an electrical signal representative of speech by said user in a high ambient noise environment, said electrical signal being transmitted to a module exterior to said user's mouth, said module retransmitting said electrical signal to a remote station.

13. The microphone apparatus of claim 12 further comprising said module receiving said a remote station and transmitting that module to an earphone or headset worn by said user.

14. The microphone apparatus of claim 13 wherein said module is mounted in proximity to said earphone or headset.

15. The microphone apparatus of claim 12 further comprising a tongue controlled switch.

16. The microphone apparatus of claim 12 wherein said tooth conduction microphone is embedded in acrylic.

17. The microphone apparatus of claim 12 wherein said electrical signal representative of speech is transmitted by RF.

18. The microphone apparatus of claim 12 wherein retransmitting said electrical signal representative to said remote station is by RF.

19. The microphone apparatus of claim 17 wherein said RF has a frequency between around 400 MHz and 500 MHz.

20. The microphone apparatus of claim 18 wherein said RE has a frequency between around 2 GHz and 3 GHz.

* * * * *